US006425579B1

(12) United States Patent
Andreyka et al.

(10) Patent No.: US 6,425,579 B1
(45) Date of Patent: Jul. 30, 2002

(54) LOW FRICTION ENVELOPE FEEDER

(75) Inventors: James B Andreyka, Monroe; Boris Rozenfeld, New Milford, both of CT (US); John W. Sussmeier, Cold Spring, NY (US); Jeffrey E. Vill, New Milford, CT (US)

(73) Assignee: Pitney Bowes Inc., Stamford, CT (US)

( * ) Notice: Subject to any disclaimer, the term of this patent is extended or adjusted under 35 U.S.C. 154(b) by 92 days.

(21) Appl. No.: 09/705,268

(22) Filed: Nov. 3, 2000

(51) Int. Cl.[7] ..... B65G 1/08

(52) U.S. Cl. ..... 271/147; 271/149; 271/126; 271/128; 271/129; 104/166

(58) Field of Search ..... 271/149, 147, 271/30.1, 31.1, 126, 128, 129, 8.1; 104/166

(56) References Cited

U.S. PATENT DOCUMENTS 3,118,393 A * 1/1964 Ohlin ..... 104/166
4,603,720 A * 8/1986 Jacoby ..... 104/166
4,620,280 A * 10/1986 Conklin ..... 104/166
4,884,795 A * 12/1989 Vander Syde ..... 271/146
5,092,575 A * 3/1992 Ramsey ..... 221/198
5,993,132 A * 11/1999 Harres et al. ..... 211/79
6,250,625 B1 * 6/2001 Janatka et al. ..... 270/58.06
6,270,070 B1 * 8/2001 Salomon et al. ..... 271/111

* cited by examiner

*Primary Examiner*—Christopher P. Ellis
*Assistant Examiner*—Richard Ridley
(74) *Attorney, Agent, or Firm*—Michael J. Cummings; Angelo N. Chaclas

(57) ABSTRACT

An envelope hopper having a plurality of bottom rods to form a supporting surface for supporting a stack of envelopes and a paddle to push the envelopes towards an envelope feeder at the downstream end. A scrub wheel is rotatably mounted on a fixed, rotation axis on the paddle and is in contact with one of the bottom rods. The rotation axis of the scrub wheel is oriented at an angle relative to the rotation axis of the contacting rod, so that when the contacting rod rotates, it causes the scrub wheel to rotate, thereby producing a force on the paddle urging the paddle to move towards the downstream end. Preferably, the envelope hopper has a side rod on one side of the envelope stack, and the supporting surface is tilted from the horizontal surface, so that the envelopes are moved towards the side rod by gravity in order to register against the side rod. Preferably, the side rod also rotates in order to reduce the friction between the envelope stack and the side rod.

15 Claims, 5 Drawing Sheets

LOW FRICTION ENVELOPE FEEDER

TECHNICAL FIELD

The present invention relates generally to an envelope feeder and, more specifically, to an envelope feeder in an envelope insertion machine.

BACKGROUND OF THE INVENTION

In a typical envelope insertion machine for mass mailing, there is a gathering section where the enclosure material is gathered before it is inserted into an envelope. This gathering section includes a gathering transport with pusher fingers rigidly attached to a conveying means and a plurality of enclosure feeders mounted above the transport. If the enclosure material contains many documents, these documents are separately fed by different enclosure feeders. After all the released documents are gathered, they are put into a stack to be inserted into an envelope in an inserting station. At the same time, envelopes are sequentially fed to the inserting station, and each envelope is placed on a platform with its flap flipped back all the way, so that a plurality of mechanical fingers or a vacuum suction device can keep the envelope on the platform while the throat of the envelope is pulled away to open the envelope.

Before envelopes are fed to the insertion station, they are usually supplied in a stack in a supply tray or envelope hopper. Envelopes are then separated by an envelope feeder so that only one envelope is fed to the insertion station at a time. For that reason, an envelope feeder is also referred to as an envelope singulator. In a high-speed insertion machine, the feeder should be able to feed single envelopes at a rate of approximately 18,000 No. 10 envelopes per hour. At this feeding rate, it is critical that only a single envelope at a time is picked up and delivered to the insertion station.

At a feeding period approximately equal to 200 ms, there are roughly 30 ms available for the feeder to reset before the next feed cycle is initiated. If an envelope is not present in close proximity before the next feed time, acquisition of the next envelope will not occur and a feed cycle will be missed, resulting in a reduced machine throughput.

SUMMARY OF THE INVENTION

The first aspect of the present invention is an envelope hopper having an upstream end and a downstream end for providing a stack of envelopes to an envelope feeder located near the downstream end. The envelope hopper comprises:

- a first bottom rod having a first rotation axis substantially parallel to a moving direction, running from the upstream end to the downstream end;
- at least one second bottom rod, which is co-located on a plane with the first bottom rod in order to form a supporting surface to support the stack of envelopes;
- a paddle, located behind the stack of envelopes and pivotally mounted at a pivot located above the supporting surface, for urging the stack of envelopes to move along the moving direction towards the envelope feeder; and
- a scrub wheel, having a second rotation axis, rotatably mounted on the paddle and positioned to make contact with the first bottom rod, with the second rotation axis being oriented at an angle relative to the first rotation axis, wherein the first bottom rod is adapted to rotate along the first rotation axis, causing the scrub wheel to rotate along the second rotation axis in response to the rotation of the first bottom rod, thereby producing an urging force on the pushing device towards the downstream end.

Preferably, the second bottom rod also rotates in order to reduce the friction between the stack of envelopes and the supporting surface.

Preferably, the envelope hopper also has a side rod parallel to the rotation axis and is located above the supporting surface for registering the stack of envelopes, and the side rod is adapted to rotate in order to reduce the friction between the stack of envelopes and the side rod.

Preferably, the supporting surface is titled from the horizontal surface, urging the envelopes to move toward the side rod in order to register against the side rod.

Preferably, the pivot is located above the supporting surface and on the opposite side of the side rod.

The second aspect of the present invention is a method for moving a stack of envelopes on an envelope hopper, wherein the stack of envelopes is supported by a supporting surface and urged to move from an upstream end towards a downstream end in a moving direction. The method comprises the steps of:

- providing a first bottom rod and at least one second bottom rod, which are co-located on the supporting surface and oriented substantially parallel to the moving direction, wherein the first bottom rod is adapted to rotate;
- providing a paddle behind the stack of envelopes for moving the stack of envelopes towards the downstream end; and
- providing a wheel rotatably mounted on a second rotation axis on the paddle, wherein the second rotation axis is oriented at an angle relative to the first bottom rod, and wherein the wheel has a frictional surface being in contact with the first bottom rod, causing the wheel to rotate in response to the rotation of the first bottom rod, thereby producing an urging force on the paddle towards the downstream end.

Preferably, the second bottom rod also rotates in order to reduce the friction between the stack of envelopes and the supporting surface.

The present invention will become apparent upon reading the description taken in conjunction with FIGS. 1 to 6.

DETAILED DESCRIPTION

Figure 1:
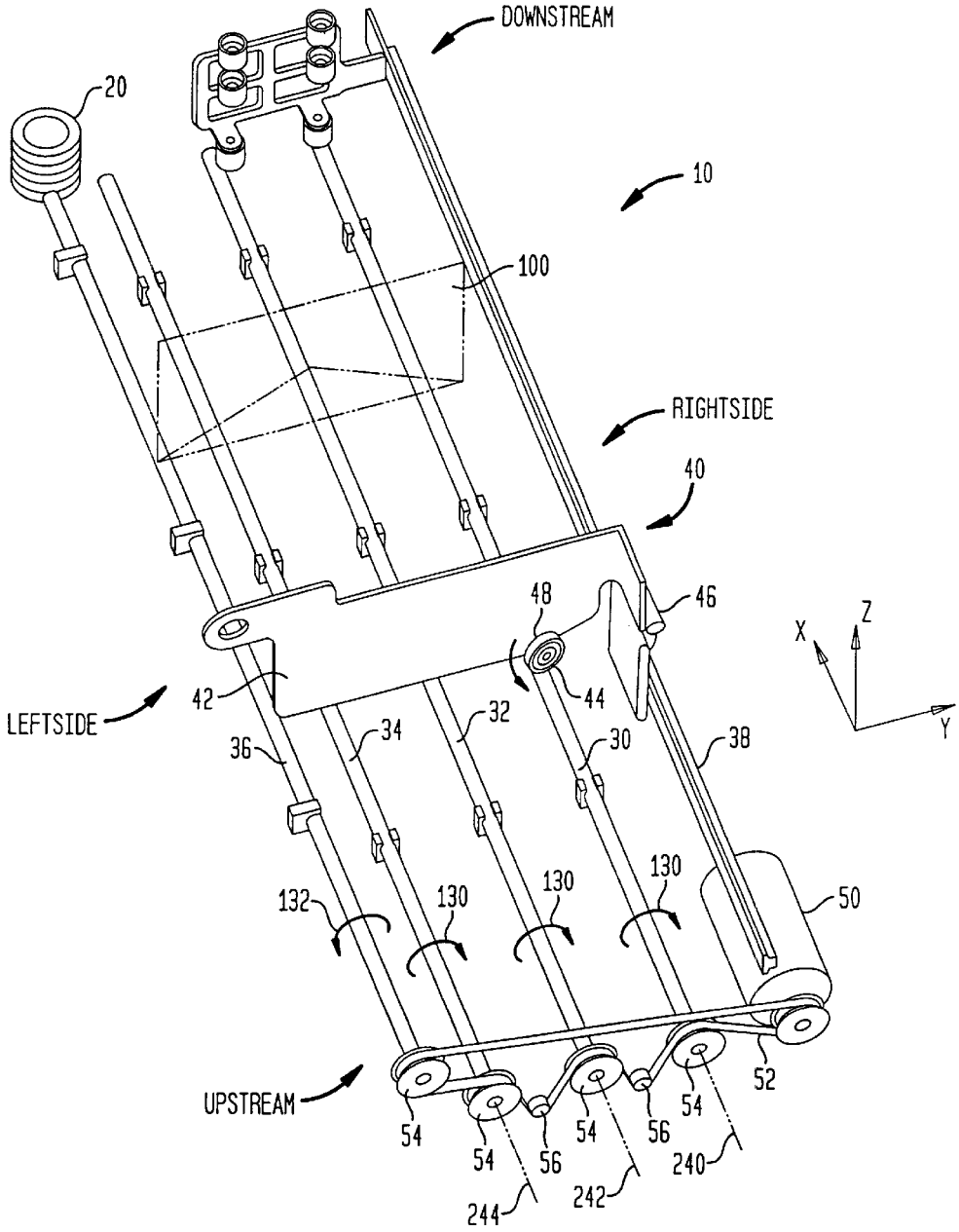
FIG. 1 is an isometric representation illustrating the envelope hopper of the present invention.

FIG. 1 illustrates the envelope hopper 10 of the present invention. As shown, the envelope hopper 10 includes a plurality of polished, bottom rods 30–34 for supporting a stack of envelopes 100 and providing the envelopes 100 to an envelope feeder 20 at the downstream end of the envelope hopper 10. As shown, the orientation of the envelope hopper 10 can be described in reference to a set of mutually orthogonal axes X, Y and Z. The rods 30–34 form a supporting surface 112 (see FIG. 2), which is parallel to the XY plane. The bottom rods 30–34 are substantially parallel to the X axis. Preferably, the envelope hopper 10 is tilted to the left such that the XY plane is rotated by angle p from a horizontal surface defined by the horizontal axis H. With such tilting, the envelopes 100 will have a tendency to move to the left side of the supporting surface 112 by gravity. A polished, side rod 36, which is also substantially parallel to X axis, is provided above the supporting surface 112 on the left-side of the envelope hopper 10 to register the left edge 102 of the envelopes 100, while the envelopes 100 are moved towards the envelope feeder 20 from upstream to downstream by an envelope pusher assembly 40. As shown in FIG. 1, the envelope pusher assembly 40 includes a stack advance paddle 42 pivotally mounted at pivot 46. The envelope pusher assembly 40 also has a rotatable scrub wheel 44 mounted on the stack advance paddle 42 at a fixed location. The scrub wheel 44 is positioned at an angle a with respect to the stack advance paddle 42 and rests on top of the rod 30 (see FIG. 3). The rods 30–34 are driven by a motor 50 via a belt 52 and a plurality of rollers 54, 56 to rotate along a rotating direction 130 along rotation axes 240–244, respectively. Preferably, the rim 48 of the scrub wheel 44 has a frictional surface so that when the bottom rod 30 rotates along the rotation direction 130, it exerts a steering force on the stack advance paddle 42 towards the downstream direction through the scrub wheel 44. The envelope pusher assembly 40 is slidably mounted on a track 38, which is also parallel to the X axis, so that it can be urged by the scrub wheel 44 to move from upstream towards downstream. Preferably, the side rod 36 is also driven by the motor 50 to rotate along a direction 132 opposite to the rotation direction 130 in order to aid the envelopes 100 to register against the side rod 36 and to reduce the friction between the envelopes 100 and the rod 36.

Figure 2:
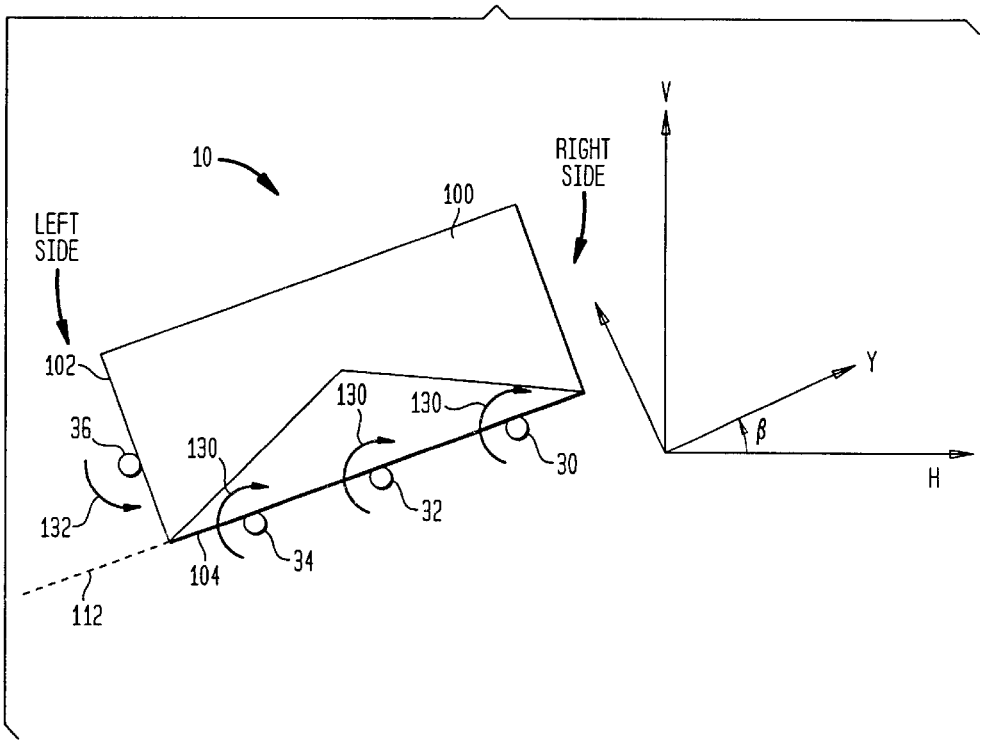
FIG. 2 is a diagrammatic representation illustrating the tilting of the supporting surface from a horizontal surface.
Figure 3:
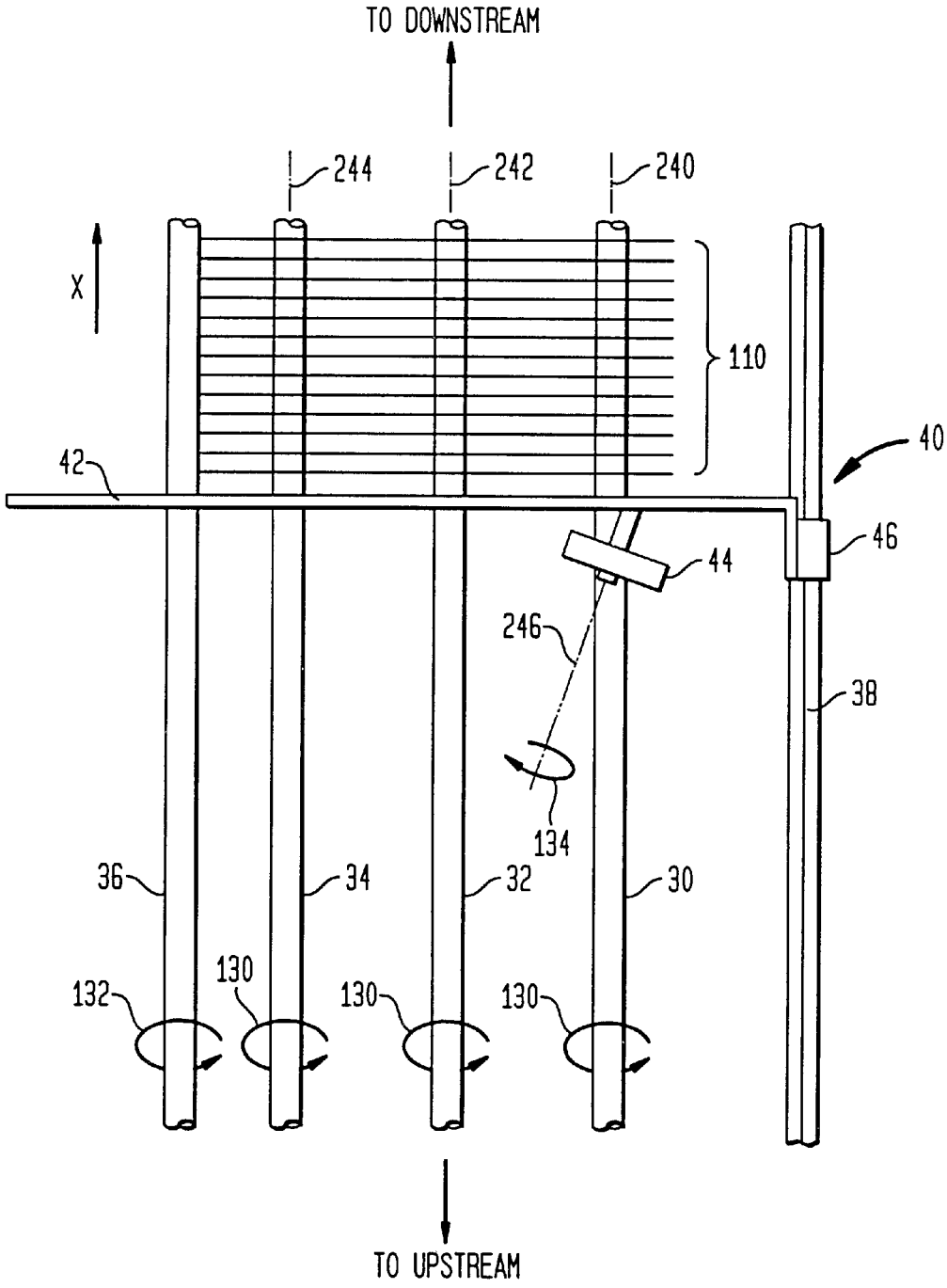
FIG. 3 is a diagrammatic representation illustrating the rotation axis of the scrub wheel in relation to the rotation axis of the bottom rods.

As shown in FIG. 2, the top edge 104 of the envelope 100 can be support by two of the bottom rods 30–32. The left edge 102 of the envelope 100 has a tendency to move toward and rest on the side rod 36. As shown in FIG. 3, the scrub wheel 44 is caused to rotate along a rotation direction 134, along a rotation axis 246, when the bottom rod 30 rotates along the rotation direction 130. Also shown in FIG. 3 is a stack 110 of envelopes 100 being pushed in the X direction towards downstream.

The arrangement of the scrub wheel 44 and the stack advance paddle 42 in relation to the rotation axis of the bottom rod 30 provides a rapid advance motion in the X direction for the stack advance paddle 42, when there is little or no force acting on the stack advance paddle 42 by the envelopes 100. In practice, the rapid advance motion only occurs when the hopper is refilled with envelopes and a gap (not shown) is produced between the envelope stack 110 and the stack advance paddle 42. As the paddle advances in the X direction and makes contact with the envelope stack 110, the paddle 42 encounters resistant forces in the stack 110. As the stack 110 compresses, the paddle velocity decreases.

Figure 4:
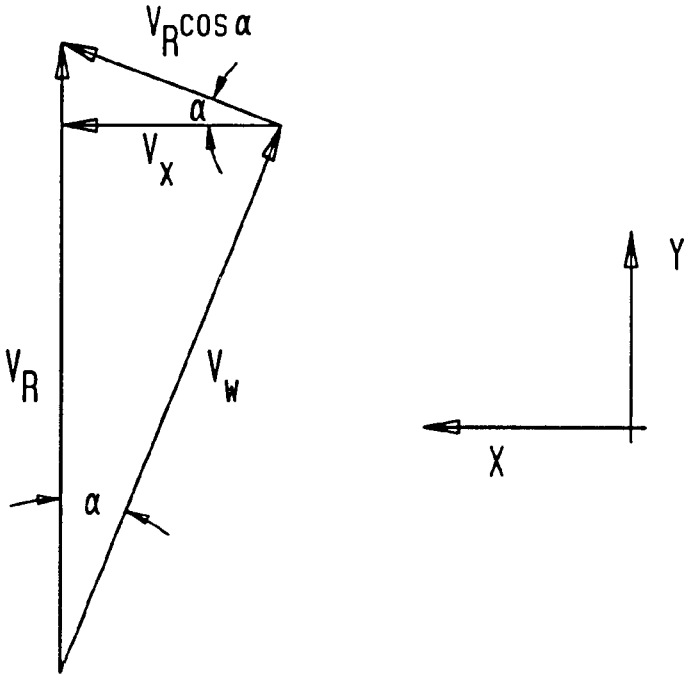
FIG. 4 is a vector diagram showing the relation between the velocity vector of the wheel and the velocity vector the bottom rod.
Figure 5:
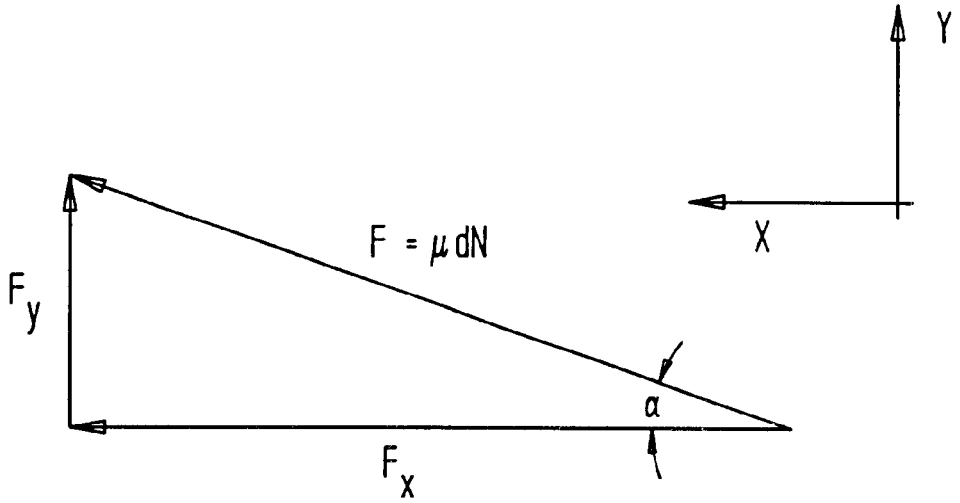
FIG. 5 is a vector diagram showing the relation between the total normal force between the wheel and the bottom rod and the force in the paddle advance direction.
Figure 6:
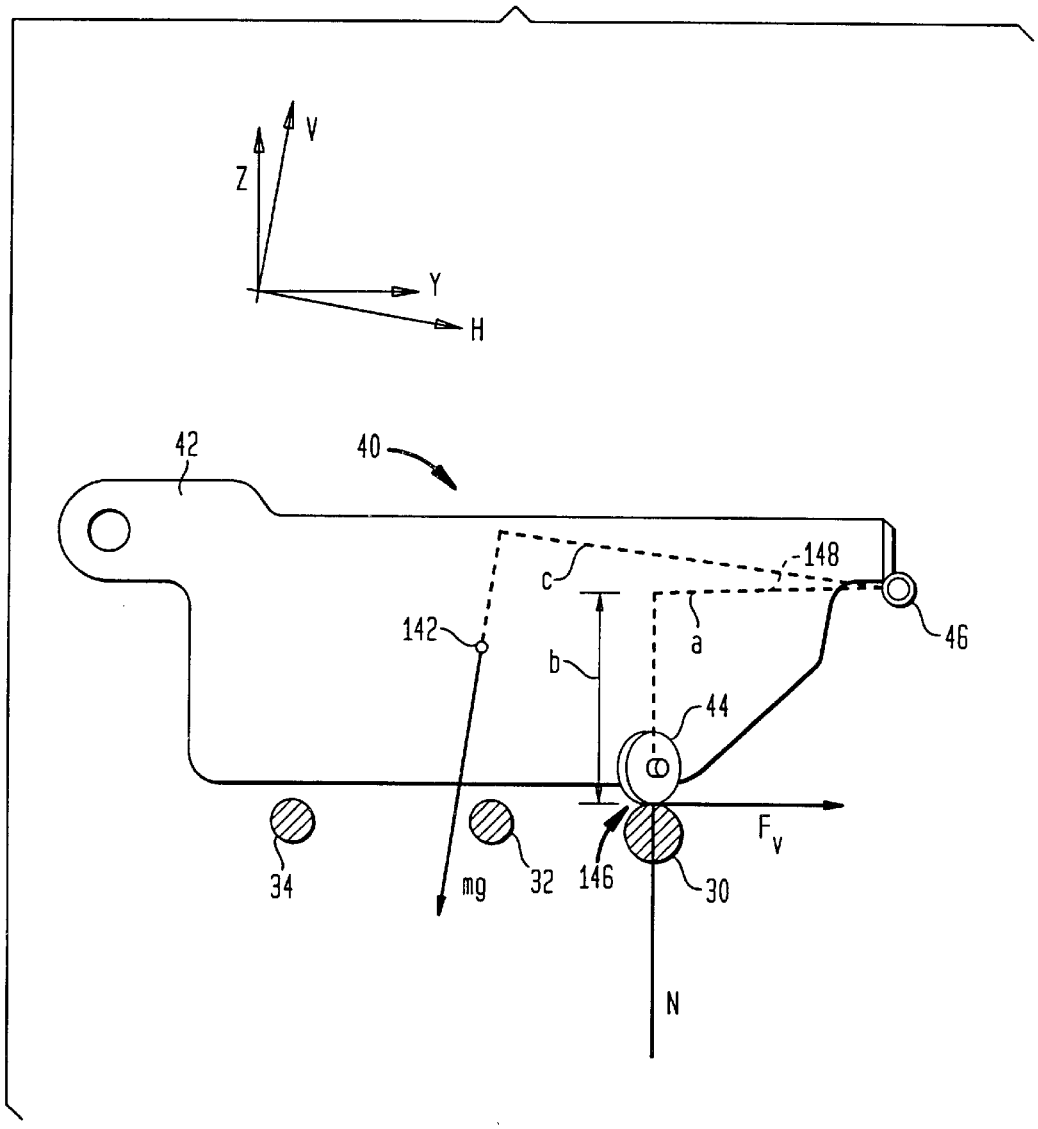
FIG. 6 is a diagrammatic representation showing moments about the pivot of the paddle arising from varies forces.

The forces and velocities are related to each other through the effect of dynamic friction vectoring. The friction force continues to rise and reaches a maximum when the paddle velocity has reached zero. This force is determined by several variables and can be manipulated to optimize the force and the maximum velocity required for optimum feeding performance. Velocity vectors are illustrated and defined in FIG. 4. As shown in FIG. 4, $V_x$ is the maximum velocity of the paddle 42 during a no-load condition, when the paddle 42 does not encounter the envelope stack 110.

$$V_X = V_R \sin\alpha \cos\alpha \tag{1}$$

Wherein $V_R$ is the velocity of the bottom rod 30. In FIG. 4, $V_W$ is the velocity of the scrub wheel 44. In order to maximize the velocity of the paddle 42 under load, it is necessary to determine the friction force along the X axis, or $F_x$, as shown in FIG. 5. It can be determined that $$F_X = F \cos\alpha \tag{2}$$

$$F_Y = F \sin\alpha \tag{3}$$

$$F = \mu_d N \tag{4}$$

where F is the total friction force developed during the operation, $\mu_d$ is the dynamic coefficient of friction between the bottom rod 30 and the scrub wheel 44, and N is the total normal force between the bottom rod 30 and the scrub wheel 44. As shown in FIG. 6, the total normal force N is related to the moments about the pivot point 46 as shown below:

$$N = (c/a)\, mg + (b/a)\, F_Y, \tag{5}$$

where mg is the weight of the paddle assembly 40, and c is the distance from the pivot point 46 to the action line 144 through the center of gravity 142 of the paddle assembly 40, a is the shortest distance between the pivot point 46 and the vector N, and b is the distance between the moment arm 148 and the contact point 146 between the scrub wheel 44 and the bottom rod 30.

By substitute $F_Y$ and F in Equations (2), (3) and (4) in Equation 5, we obtain $$N = (c/a)mg/\{1-(b/a)\mu_d \sin\alpha\} \tag{6}$$

and $$F_X = \mu_d\, (c/a)mg \cos\alpha/\{1-(b/a)\, \mu_d \sin\alpha\} \tag{7}$$

The optimal condition can be found by differentiating Equation (7) with respect to the variable $\alpha$. The optimal angle $\alpha$ is related to the dynamic coefficient $\mu_d$ and the linear dimensions a, b. It should be noted that when $(b/a)\mu_d \sin\alpha = 1$, $F_X$ becomes infinitively large. Under such circumstances, a self-locking, jam condition develops.

It should be noted that the optimal velocity depends on the surface of the bottom rod 30, the surface of the scrub wheel 44 and the friction between the scrub wheel 44 and the axis 45 on which it is mounted. The above equations will usually give only a rough estimate of the required rod velocity $V_R$. It has been empirically determined that the optimal velocity of the bottom rods is preferably fifteen (15) inches per second, creating a near frictionless surface. The bottom rods have a corresponding angle a of preferably 10° to 20°, and the tilting angle $\beta$ of the hopper relative to a horizontal surface has been found to be advantageous at 30°. Of course the given values for the aforesaid angles $\alpha$ and $\beta$ are only given as preferred angles and may be varied to suit any given application of use. The rotation of the bottom rods 32, 34 will also reduce the friction between the envelope stack 110 and the rods 32, 34, or the friction between the envelope stack 110 and the support surface 112. It is possible to have one or more other scrub wheels, responsive to the rotation of the bottom rods 32 and 34, to provide additional force for pushing the stack advance paddle 42 towards the downstream end of the envelope hopper 10. However, this variation does not depart from the principle of using a rotating rod and a scrub wheel to provide a pushing force to the envelope stack, according to the present invention.

Thus, although the invention has been described with respect to a preferred embodiment thereof, it will be understood by those skilled in the art that the foregoing and various other changes, omissions and deviations in the form and detail thereof may be made without departing from the spirit and scope of this invention.

What is claimed is:

1. An envelope hopper having an upstream end and a downstream end for providing a stack of envelopes to an envelope feeder located near the downstream end, said envelope hopper comprising:

a rod, having a first rotation axis substantially parallel to a moving direction, running from the upstream end to the downstream end;

supporting means, which is co-located on a plane with the rod in order to form a supporting surface to support the stack of envelopes;

a pushing device, located behind the stack of envelopes and pivotally mounted at a pivot positioned above the supporting surface, for urging the stack of envelopes to move along the moving direction towards the envelope feeder; and rotation means, having a second rotation axis, rotatably mounted on the pushing device and positioned to make contact with the rod, with the second rotation axis oriented at an angle relative to the first rotation axis, wherein the rod is adapted to rotate along the first rotation axis, causing the rotation means to rotate along the second rotation axis in response to the rotation of the rod, thereby producing an urging force on the pushing device towards the downstream end.

2. The envelope hopper of claim 1, wherein the support means comprises at least one further rod having a third rotation axis substantially parallel to the first axis.

3. The envelope hopper of claim 2, wherein said at least one further rod is adapted to rotate along the third rotation axis in order to reduce friction between the further rod and the stack of envelopes.

4. The envelope hopper of claim 1, wherein the rotation means comprises a wheel having a perimeter surface in order to produce a friction force between the wheel and the rod.

5. The envelope hopper of claim 1, further comprising means, mounted above the support surface, for registering the stack of envelopes.

6. The envelope hopper of claim 5, wherein the registering means comprises a further rod.

7. The envelope hopper of claim 6, wherein the further rod is adapted to rotate in order to reduce friction between the further rod and the stack of envelopes.

8. The envelope hopper of claim 7, wherein the rod rotates along a first rotation direction and the further rod rotates along a second rotation direction, which is opposite to the first rotation direction.

9. The envelope hopper of claim 8, wherein the supporting surface has a first side and an opposing second side separated by a distance along a further direction, which is substantially perpendicular to the first rotation axis, and wherein the supporting surface is tilted to the first side relative to a horizontal plane, and the registering means is located on the first side of the supporting surface.

10. The envelope hopper of claim 9, wherein the pivot is located on the second side of the support surface.

11. A method for moving a stack of envelopes on an envelope hopper, wherein the stack of envelopes is supported by a supporting surface and urged to move from an upstream end towards a downstream end in a moving direction, said method comprising the steps of:

providing a rod having a first rotation axis located on the supporting surface and oriented substantially parallel to the moving direction, wherein the rod is adapted to rotate;

providing a pushing means located behind the stack of envelopes; and providing a rotation means rotatably mounted on a second rotation axis on the supporting surface, wherein the second rotation axis is oriented at an angle relative to the first rotation axis, and wherein the rotation means has a frictional surface being in contact with the rod, causing the rotation means to rotate in response to the rotation of the rod, thereby producing an urging force on the pushing means to push the stack of envelopes towards the downstream end.

12. The method of claim 11, further comprising the step of providing at least one further rod located on the supporting surface and being substantially parallel with the first rotation axis, wherein said at least one further rod is adapted to rotate in order to reduce friction between the stack of envelopes and the supporting surface.

13. The method of claim 11, wherein the supporting surface has a first side and an opposing second side, separated by a distance along a direction substantially perpendicular to the moving direction, and wherein the supporting surface is tilted to the first side from a horizontal surface, said method further comprising the step of providing a registering means located above the supporting surface and on the first side of the supporting surface in order to register the stack of envelopes.

14. The method of claim 13, wherein the registering means comprises a further rod having a third rotation axis substantially parallel to the first rotation axis, and wherein the further rod is adapted to rotate in order to reduce friction between the registering means and the stack of envelopes.

15. The method of claim 13, wherein the pushing means is pivotally mounted above the supporting surface and on the second side thereof.

* * * * *